United States Patent [19]

Wokeck et al.

[11] Patent Number: 5,062,374

[45] Date of Patent: Nov. 5, 1991

[54] ROTARY THREAD CUTTER FOR A SEWING MACHINE

[75] Inventors: Arthur C. Wokeck, Mauldin; Theodore Opuszenski, Greenville, both of S.C.

[73] Assignee: Clinton Industries, Inc., Carlstadt, N.J.

[21] Appl. No.: 572,051

[22] Filed: Aug. 23, 1990

[51] Int. Cl.[5] ..... D05B 37/04

[52] U.S. Cl. ..... 112/130; 112/289

[58] Field of Search ..... 112/122.3, 129, 130, 112/289, 288; 83/639.1, 491, 485, 902

[56] References Cited

U.S. PATENT DOCUMENTS

| | | | |
|---|---|---|---|
| 3,135,229 | 6/1964 | Heckethorn | 112/122.3 |
| 3,144,844 | 8/1964 | Elliott et al. | 112/289 X |
| 3,149,595 | 9/1964 | Zeltner, Jr. | 112/289 X |
| 3,369,509 | 2/1968 | Burton | 112/129 |
| 3,808,992 | 5/1974 | Mall | 112/122.3 X |
| 3,886,879 | 6/1975 | Frost et al. | 112/289 |
| 4,108,098 | 8/1978 | Keeton | 112/289 |

FOREIGN PATENT DOCUMENTS

| | | | |
|---|---|---|---|
| 963059 | 7/1964 | United Kingdom | 112/122.3 |

*Primary Examiner*—Werner H. Schroeder
*Assistant Examiner*—Paul C. Lewis
*Attorney, Agent, or Firm*—Darby & Darby

[57] ABSTRACT

A thread cutter for a sewing machine uses a circular rotary cutter mounted to the sewing machine. The thread cutter includes a body having an air motor disposed therein. A circular blade is supported on a shaft extending from the air motor. The cutter body is reciprocally supported on a rod fixed at one end to a mounting plate. The rod is disposed in a cylinder within the body and has a piston end, air supplied to one side or the other of the piston driving the cutter body reciprocally into and out of engagement with any threads trailing from a sewn article.

6 Claims, 2 Drawing Sheets

ROTARY THREAD CUTTER FOR A SEWING MACHINE

TECHNICAL FIELD

This invention relates to cutters for sewing machines, and more particularly to a rotary cutter for cutting various types of trim, thread, strips, tapes or plastic zippers automatically after an article has been sewn.

BACKGROUND

Sewing machines typically include a knife blade for cutting the trailing threads after an article has been sewn. These threads are gathered and pressed against the knife blade by the operator or the knife is pressed against the threads manually or using hand held scissors. In industrial settings where throughput is important, this is a time consuming operation which typically causes delays, particularly when the knife blade becomes dull and must be replaced or sharpened. Also, with manual operation, the neatness of the cut may vary from operator to operator.

OBJECTS OF THE INVENTION

It is an object of the present invention to provide a thread cutter which automatically cuts the trim, thread, strips, tapes or plastic zippers between articles.

It is another object to provide a thread cutter which has a rotary blade for improving cutting efficiency.

It is another object to provide a rotary thread cutter with a tailored guide to assure thread bunching and guiding prior to cutting, while preventing damage to the article.

It is another object to provide a rotary thread cutter which consistently provides neat thread cuts and accurate trim cuts.

These and other objects of the present invention are achieved by providing a rotary thread cutter for a sewing machine comprising:

a circular blade;

means for rotating the circular blade; and, means for moving the circular blade into engagement with a thread or trim.

DETAILED DESCRIPTION OF THE INVENTION

Figure 1:
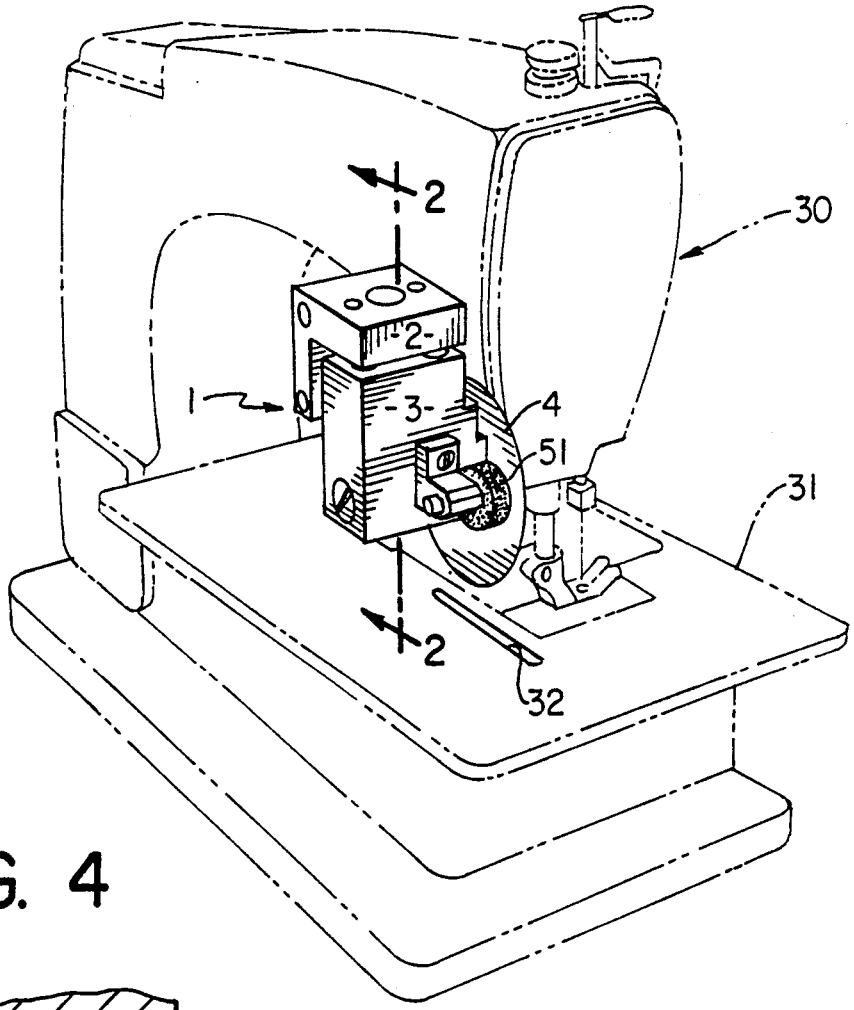
FIG. 1 is a perspective view of a sewing machine in phantom lines and showing the rotary cutter of the present invention in full lines.

Referring to FIG. 1, the cutter assembly 1 has a mounting plate 2, a cutter support body 3 and a circular blade 4. The mounting plate 2 is configured for attachment to a sewing machine shown in phantom.

Figure 2:
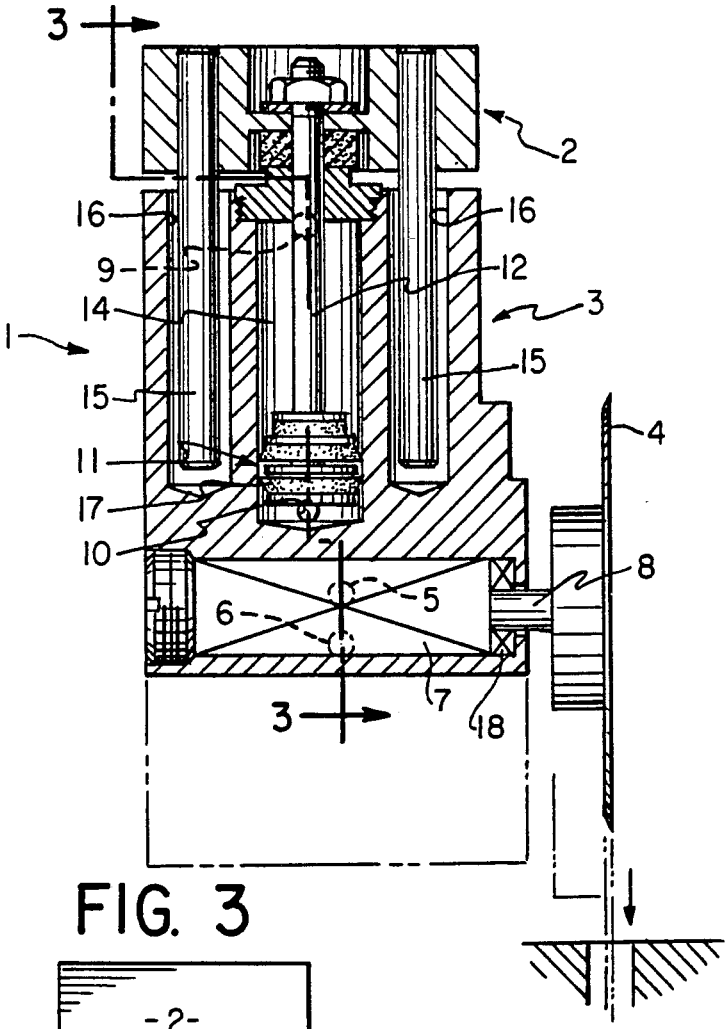
FIG. 2 is a cross-sectional view of the cutter of the present invention taken along the line 2—2 of FIG. 1.

Referring to FIG. 2, the cutter 1 is shown in crosssection. The body 3 has first and second air passages 5 and 6 for driving a conventional pneumatic motor 7. The motor 7 has a shaft 8 which supports the blade 4. The body also has a pair of air ports 9 and 10 which are disposed on opposite sides of a piston 11.

The piston 11 is mounted on a rod 12 which is attached by a nut 13 to the mounting plate 2. The piston is slidably disposed in a cylinder 14 in the body 3. Thus, when air is supplied to one side of the piston 11, the cutter support body 3 will move in either an upward or direction relative to the mounting plate 2. The downward position is shown in phantom. A pair of guide pins 15, fixed at one end to plate 2 and disposed within guide channels 16 assure alignment of the plate 2 and body 3 during displacement. The piston 11 has seals 17 which prevent air leakage around the piston 11.

The motor 7 may be of any suitable type with a pneumatic motor preferred since an air source is available. Of course, an electric motor could also be used. The shaft 8 extends from the motor 7 and is rotatably supported by bearing 18. Actuation of the motor 7 causes rotation of the shaft 8 and blade 9 for cutting.

In operation, air is supplied simultaneously to passage 6 and port 10. This initiates spinning of the blade 4 and forces the body 3 and blade 9 downwardly. By proper mounting on the sewing machine, as illustrated in FIG. 1, threads disposed in the path of the blade 9 are quickly and easily cut.

Figure 3:
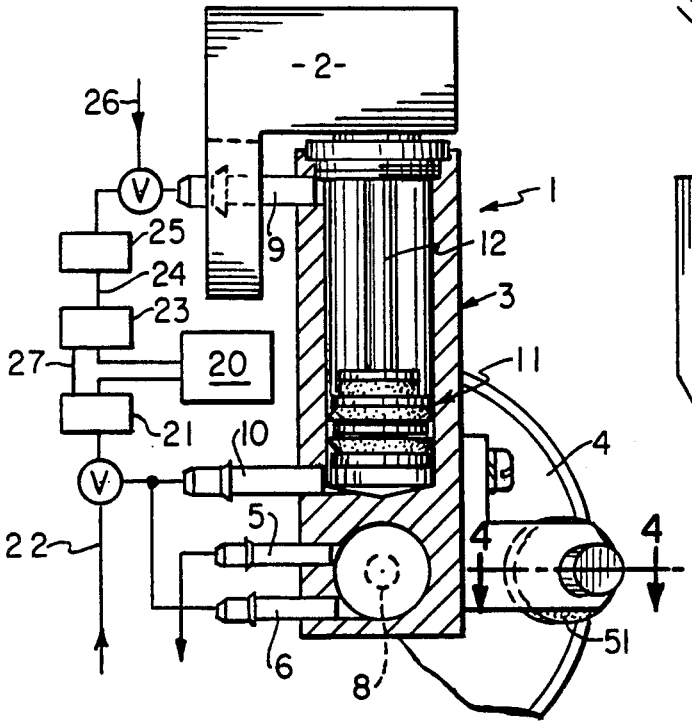
FIG. 3 is a side cross-sectional view showing the cutter of the present invention taken along the line 3—3 of FIG. 2.

In one embodiment of the invention, illustrated in FIG. 3, the air supplied to the passage 6 and motor 7 is intiated in response to a control signal 20 indicating the absence of an article beneath the blade 4. An electric eye or mechanical limit switch may indicate such passage of an, article, and transmit the control signal to a solenoid valve 21 controlling an air supply 22 to initiate blade rotation and descent. After descent, a timer, proximity switch or other means 23 may be used to note completion of the downstroke and send a second signal 24 to a solenoid 25 to switch an air supply 26 to port 9 and send a third signal 27 to stop the flow of air to the motor 7 and to vent port 10. Thus, the cutter blade 4 stops rotation and is returned to its disengaged, upward position.

As seen in FIG. 1, a sewing machine 30 has a base plate 31 with a mating slot 32 (shown in solid form) for accepting the circular blade therein. This assures that all threads within a fairly wide area are cut. Of course, the distance traversed by the blade is dependant on the length of the piston rod and adjustments or stops could be included to vary the travel of the cutter support body 3.

Figure 4:
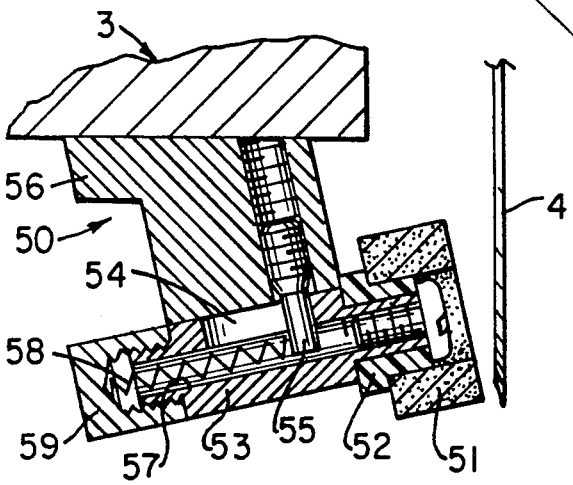
FIG. 4 is a cross-sectional view of a blade sharpener usable with the present invention.

Referring to FIG. 4, a blade sharpener 50 is mounted on the body 3. The sharpener 50, has a stone 51 mounted on a bearing 52 disposed on an end of a shaft 53. The shaft has a slot 54 within which a stop 55 is disposed which extends from a base 56. A channel 57 within the shaft 53 contains a spring 58. A threaded cap 59 is disposed on the end of the shaft 53 to contain the spring 50 in the channel. By pressing the cap to overcome the biasing of the spring 58, while the circular blade 4 is rotating, the stone is driven into contact with the blade edge, to effect sharpening without interrupting machine operation.

Figure 5:
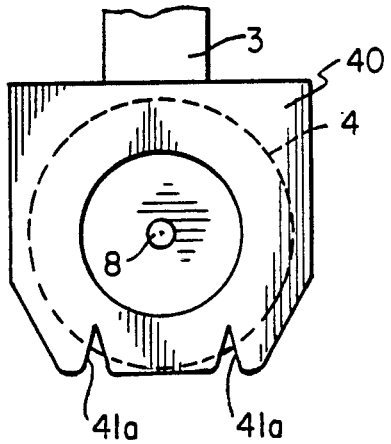
FIG. 5 shows an alternative embodiment using a guide plate for safely guiding the threads, tapes or zippers to the cutter.

Referring to FIG. 5, in another embodiment of the present invention, a face plate 40 is mounted on the body 3. The face plate 40 surrounds a substantial portion of the circular blade 4 to act as a guard to prevent inadvertent contact with the rotating blade 4. One or more openings may be provided in the face plate 40 through which the threads contact the blade 4. As shown, two tapered slots 41*a* are used to guide the threads into engagement with the blade 4. Such slots may correspond, for example, to the trailing edge of a zipper disposed on opposite sides of a zipper being sewn into a garment. Of course, any configuration of opening which accesses the trailing threads, tape, ribbon, zippers, etc. to the blade could be used.

Utilizing a circular blade increases the amount of cutting surface which correspondingly increases the time between replacements. Utilizing rotary action increases cutting efficiency as the rotary action adds torque which enhances the cutting action. Thus, the rotary blade of the present invention may be used to cut off material as well as threads. For example, various types of trim, thread, strips, tapes or plastic zippers the ends of a zipper may be trimmed using the present invention. Also, the cutter of the present invention is readily adaptable to automated operation, to provide consistent, rapid thread cutting between articles.

While an embodiment using a pneumatic air motor and a pneumatic air cylinder is discussed, it will be understood by those skilled in the art that various modifications could be made to the cutter without varying from the scope of the present invention.

We claim:

1. A rotary cutter for a sewing machine having a mounting plate, said rotary cutter comprising:

a circular blade movable into engagement with an article to be cut;

means for rotating said circular blade;

a housing for supporting said rotating means; and means for attaching said housing to the mounting plate for reciprocal movement relative thereto to provide for engagement of said circular blade with the article to be cut, said attaching means including a piston member fixedly connected to the mounting plate, said housing having a cylinder in which said piston member is located, and conduit means for supplying a pressure fluid alternatively to opposite sides of said piston member to effect reciprocal movement of said cylinder and thereby of said housing relative to said piston member.

2. A rotary cutter as set forth in claim 1, wherein said piston member has a rod extending in said cylinder and having one end thereof fixed to the mounting plate.

3. A rotary cutter as set forth in claim 1, wherein said housing has at an end thereof remote from the mounting plate a cavity extending transverse to an axis of said cylinder, and said rotating means comprises a motor located in said cavity and having a shaft for supporting said blade.

4. A rotary cutter as set forth in claim 1, wherein said motor is a fluid motor, and said housing has additional conduit means for supplying pressure fluid to said fluid motor.

5. A rotary cutter as set forth in claim 1, further comprising a face plate substantially surrounding said circular blade and having narrow opening means for guiding a thread into engagement with the blade.

6. A rotary cutter as set forth in claim 1, further comprising means for sharpening said circular blade and including a base fixedly attached to said housing for joint reciprocal movement therewith and a stone supported on said base and movable into engagement with said circular blade for sharpening same.

* * * * *